US010846969B2

(12) United States Patent
Gnana Nesan et al.

(10) Patent No.: US 10,846,969 B2
(45) Date of Patent: Nov. 24, 2020

(54) APPARATUS FOR PROCESSING DOCUMENTS OF VALUE

(71) Applicant: GIESECKE+DEVRIENT CURRENCY TECHNOLOGY GMBH, Munich (DE)

(72) Inventors: Bentin P. Gnana Nesan, Kerala (IN); Lalit Pal Singh, Uttar Pradesh (IN); Poobalan Subramani, Chennai (IN)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 16/308,936

(22) PCT Filed: Jun. 12, 2017

(86) PCT No.: PCT/EP2017/000686
§ 371 (c)(1),
(2) Date: Dec. 11, 2018

(87) PCT Pub. No.: WO2017/215783
PCT Pub. Date: Dec. 21, 2017

(65) Prior Publication Data

US 2019/0311567 A1 Oct. 10, 2019

(30) Foreign Application Priority Data

Jun. 14, 2016 (IN) ..... 20 1631 020 335

(51) Int. Cl.
*G07D 11/40* (2019.01)
*G07D 11/50* (2019.01)
(Continued)

(52) U.S. Cl.
CPC ..... *G07D 11/40* (2019.01); *B65H 3/0669* (2013.01); *G07D 11/26* (2019.01); *G07D 11/50* (2019.01);
(Continued)

(58) Field of Classification Search
CPC ..... G07D 11/40; G07D 11/50; G07D 11/26; G07D 11/24; G07D 11/16; G07D 11/165;
(Continued)

(56) References Cited

U.S. PATENT DOCUMENTS 6,311,819 B1 * 11/2001 Stromme ..... G07D 7/00 194/207
6,772,886 B2 * 8/2004 Werner ..... G07D 11/40 209/534
(Continued)

FOREIGN PATENT DOCUMENTS

DE 19958017 A1 6/2001
EP 1864925 A2 12/2007
(Continued)

OTHER PUBLICATIONS

International Search Report from PCT Application No. PCT/EP2017/000686, dated Sep. 22, 2017.

*Primary Examiner* — Luis A Gonzalez
(74) *Attorney, Agent, or Firm* — Workman Nydegger

(57) ABSTRACT

An apparatus for processing documents of value comprises a stationary part and a movable part. The stationary part comprises a singler for singling a stack of documents. The movable part comprises at least two output pockets for receiving processed documents. The movable part is mounted to the stationary part so as to be pivotable between a closed position and an open position. The stationary part and the movable part are arranged to form a transport path when in the closed position. The stationary part and the
(Continued)

movable part are arranged to allow access to at least a section of the transport path when in the open position. The apparatus is arranged to transport singled documents of value from the singler along the transport path to the output pockets.

27 Claims, 14 Drawing Sheets

(51) Int. Cl.
*G07D 11/26* (2019.01)
*B65H 3/06* (2006.01)

(52) U.S. Cl.
CPC .. *B65H 2402/441* (2013.01); *B65H 2511/528* (2013.01)

(58) Field of Classification Search
CPC ..... B65H 2402/441; B65H 2511/528; B65H 29/40
See application file for complete search history.

(56) References Cited

U.S. PATENT DOCUMENTS

| | | | | |
|---|---|---|---|---|
| 6,880,692 | B1 | 4/2005 | Mazur et al. | |
| 8,336,715 | B2 * | 12/2012 | Koga | G07D 11/40 209/534 |
| 8,746,695 | B2 * | 6/2014 | Jang | G07D 11/50 271/264 |
| 10,055,923 | B2 * | 8/2018 | Xu | G07D 7/183 |
| 2003/0038062 | A1 | 2/2003 | Werner et al. | |
| 2004/0154964 | A1 * | 8/2004 | Jones | G07F 19/20 209/534 |
| 2010/0138308 | A1 * | 6/2010 | Fujita | G06Q 20/20 705/16 |
| 2014/0209518 | A1 * | 7/2014 | Mishra | G07D 11/009 209/534 |
| 2016/0371914 | A1 * | 12/2016 | Hodatsu | G07D 11/26 |

FOREIGN PATENT DOCUMENTS

| | | | |
|---|---|---|---|
| EP | 2991047 | A1 | 3/2016 |
| JP | 2007133467 | A * | 5/2007 |

* cited by examiner

APPARATUS FOR PROCESSING DOCUMENTS OF VALUE

BACKGROUND

The present invention relates to an apparatus for processing documents of value, in particular banknotes.

Value documents or documents of value are understood here to be sheet-shaped objects that represent for example a monetary value or an authorization and are hence not to be producible at will by unauthorized persons. Hence, they have features that are not easily produced, in particular copied, whose presence is an indication of authenticity, i.e. production by an authorized body. Important examples of such value documents are coupons, vouchers, checks and in particular bank notes.

Documents of value, in particular banknotes, are often processed using an apparatus for processing documents of value. Such an apparatus may be designed to process a stack of documents put into an input section. When processing the documents the apparatus transports the documents one-by-one along a transport path to an output section comprising one or more output receptacles. The apparatus transports a document from the input section past a sensor arranged at the transport path. The sensor captures properties of the document and outputs corresponding sensor signals which the apparatus uses to control a transport system to transport the documents to an output receptacle in response to the sensor signals.

When processing documents of value, in particular during transporting, jams may occur due to dog ears, folds or crumples of documents. In that case, the jammed documents have to be removed from the transport path. For that purpose, it should be possible to access the transport path easily.

SUMMARY

In accordance with one aspect to the present invention an apparatus for processing documents of value according to claim 1 is provided. The apparatus for processing documents of value comprises a stationary part and a movable part. The stationary part comprises a singler for singling a stack of documents, that is for separating single documents from a stack of documents and feed these to the transport path. The movable part comprises at least two output pockets for receiving processed documents. The movable part is mounted to the stationary part so as to be pivotable between a closed position and an open position. The stationary part and the movable part are arranged to form a transport path when the movable part is in the closed position. Further, the stationary part and the movable part are arranged to allow access to at least a section of said transport path when the movable part is in the open position. The apparatus is arranged to transport singled documents of value from said singler along said transport path to said output pockets.

Preferably, the stationary part and the movable part are arranged to form a section of the transport path in the closed position that is fully accessible by a user when the movable part is in the opened position.

Thus, an apparatus according to the invention allows easy removal of jams simply be moving the movable part from the closed position to the open position.

In a preferred embodiment said movable part may be mounted to said stationary part so that it is pivotable in a vertical plane. The plane is vertical if the apparatus in a working position and rests on the stationary part. Further, the transport path may extend in a plane parallel to said vertical plane or in said vertical plane.

In case that the movable part is swiveled downwards, it is preferred that the apparatus further comprises a restraining member arranged to limit a pivoting range of the movable part. In particular, the restraining member may be arranged to hold the movable part in the opened position. This has the advantage that a user does not need to use one hand to keep the movable member in the open position. Preferably, the stationary part comprises this restraining member.

The apparatus may comprise a transport system arranged to transport documents of value along the transport path. In a preferred embodiment the stationary part and the movable part may comprise transport elements to transport said singled documents along the transport path. Preferably, the movable part comprises a transport motor arranged to drive at least some of those transport elements. In particular, at least some of said transport elements of the movable part may be arranged to be driven by the transport motor. This design has the advantage that all driven parts of the transport are contained in the movable part and no transmission to the stationary part is necessary. Hence, the transport system comprises the transport motor and the transport elements.

In the apparatus the transport path may have branches leading to the output pockets. In that case the transport elements may comprise at least one diverting element arranged to direct a document transported along the transport path towards one or the other of said branches. Preferably the diverting elements and/or the actuator for actuating the diverting elements are arranged in the movable part, i. e. form part of the movable part. Again, this arrangement has the advantage, that the diverting elements and the actuators, e.g. solenoids, are held in movable part, so that no corresponding transmission between the stationary part and the movable part is necessary and adjustment is made easier. In particular, the section of the transport path accessible when the movable part is in the open position may be the section from said singler to the topmost of said branches. It may be accessible for a user when the movable part is in the open position. As a consequence only a single part has to be moved to obtain access to the section of the transport path mentioned.

In the apparatus according to the invention, the singler is arranged in the stationary part. In a preferred embodiment the singler may be a singler module mounted in said stationary part. In particular, the singler module may comprise a singler motor for driving the singler, in particular arranged to drive the singler. That way, all movable parts of the singler are contained in one module that may be manufactured separately. As well the module could be replaced easily. In particular, the singler module may be mounted in the stationary part such that it can be removed as a whole from the stationary part. Further, no transmission from the transport motor is necessary to drive the singler.

In some embodiments of the apparatus the stationary part may comprise a stationary base module and a first stationary extension module mounted on top of the stationary base module and the movable part may comprise a movable base module and a first movable extension module mounted to the movable base module and having an output pocket and wherein said base modules and said extension modules respectively are complementary to each other to form at least sections of said transport path.

In a preferred variant, said movable part may comprises at least one further movable extension module mounted on top of the first movable extension module or one of the movable extension modules and having an output pocket, and said first stationary extension module, said first movable extension module and the at least one further extension module may be arranged to form a section of said transport path when said stationary part and said movable part are in the closed position. As a single stationary extension module, the first stationary extension module and at least two movable extension modules form a section or sections of the transport path, precise alignment of the modules may obtained quite easily.

In another preferred variant, the stationary part may further comprise at least one further stationary extension module mounted on top of the first stationary extension module or one of the stationary extension modules and the movable part may comprise at least one further movable extension module mounted on top of the first movable extension module or one of the movable extension modules and having an output pocket, the at least one further stationary extension module and the at least one further extension module being arranged to form a section of said transport path when said stationary part and said movable part are in the closed position. In that way different versions of the apparatus having different numbers of output pockets may be manufactured at low cost.

In both variants, the extension modules may preferably be of the same type, i.e. equal.

In these embodiments it is preferred that the singler is arranged in the stationary base module and the transport motor is arranged in the movable base module. In particular, the singler module may be arranged in the stationary part, preferably in the stationary base module, so that it is below the output pockets when the movable part is in the closed state. The movable part may comprise driven and driving components of the transport system for transporting the documents of value. This increases the reliability of the apparatus.

In a preferred embodiment the at least one further movable extension module may comprise transport elements and is arranged so that at least some of the transport elements are driven by the movable extension module below said at least one movable extension module. This results in a very simple design of the transport system.

Further, at least one of said movable extension modules may comprise a diverting element and an actuator for actuating the diverting element, said diverting element and actuator being arranged to direct documents of value to a branch of the transport path leading to one other of the movable extension modules or to the output pocket of said at least one of said extension modules in response to signals received by the actuator. This design allows to use movable extension modules of the same design which may only differ in having said actuator and preferably said diverting element.

In order to allow neatly stacking the processed documents, in the apparatus according to the invention a stapler wheel may be arranged between the transport path and at least one of said output pockets to staple documents of value transported to said output pocket into said output pocket.

In the case that the apparatus comprises at least one movable extension module, e. g. the first extension module, having a stapler wheel, that stapler wheel is preferably driven by the movable module below said extension module via a transmission element, preferably a belt.

The apparatus according to the invention may further comprise a sensor arrangement having a first sensor part mounted in the stationary part and a second sensor part mounted in the movable part on opposite sides of the transport path and between the singler and the output pockets, said sensor module being arranged to detect at least one property of a document of value passing the sensor module and outputting sensor data representing the detected at least one property. Further, the apparatus may comprise a control device arranged to receive and evaluate the sensor data and emitting a control signal to the actuator at least one of the actuators for actuating the diverting element or one of the diverting elements.

The apparatus according to the invention may further comprise a dust collection element arranged in the stationary part below the singler and arranged to be drawn out of the stationary part to allow removing dust from the dust collection element. In particular, the dust collection element may be formed as a drawer to be pulled out of and pushed back into the stationary part. This variant of the apparatus has the advantage, that dust can be removed from the apparatus without moving the movable part.

According to another aspect of the invention in a method of accessing a transport path of an apparatus according to invention, the movable part is moved into the open position by a single movement so that access to the main section of the transport path is possible.

BRIEF DESCRIPTION OF THE DRAWINGS

Illustrative embodiments in accordance with the invention will now be described with reference to accompanying drawings, in which:

FIG. 8 shows a perspective view of a movable base module of the movable part in

FIG. 7,

DETAILED DESCRIPTION OF VARIOUS EMBODIMENTS

Figure 1A:
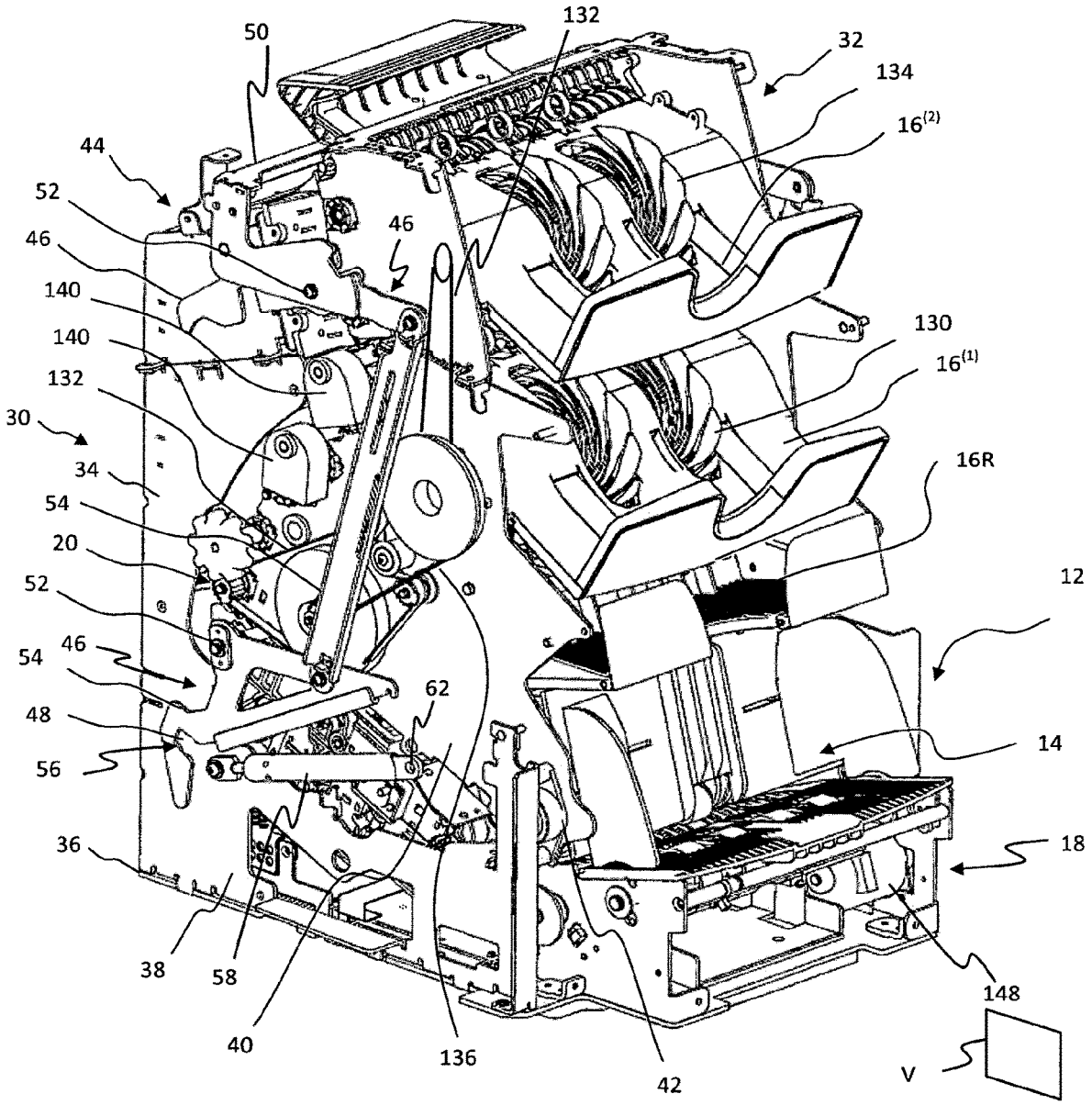
FIGS. 1A and 1B show left and right perspective views of a first embodiment of an apparatus for processing documents of value in a closed position.
Figure 1B:
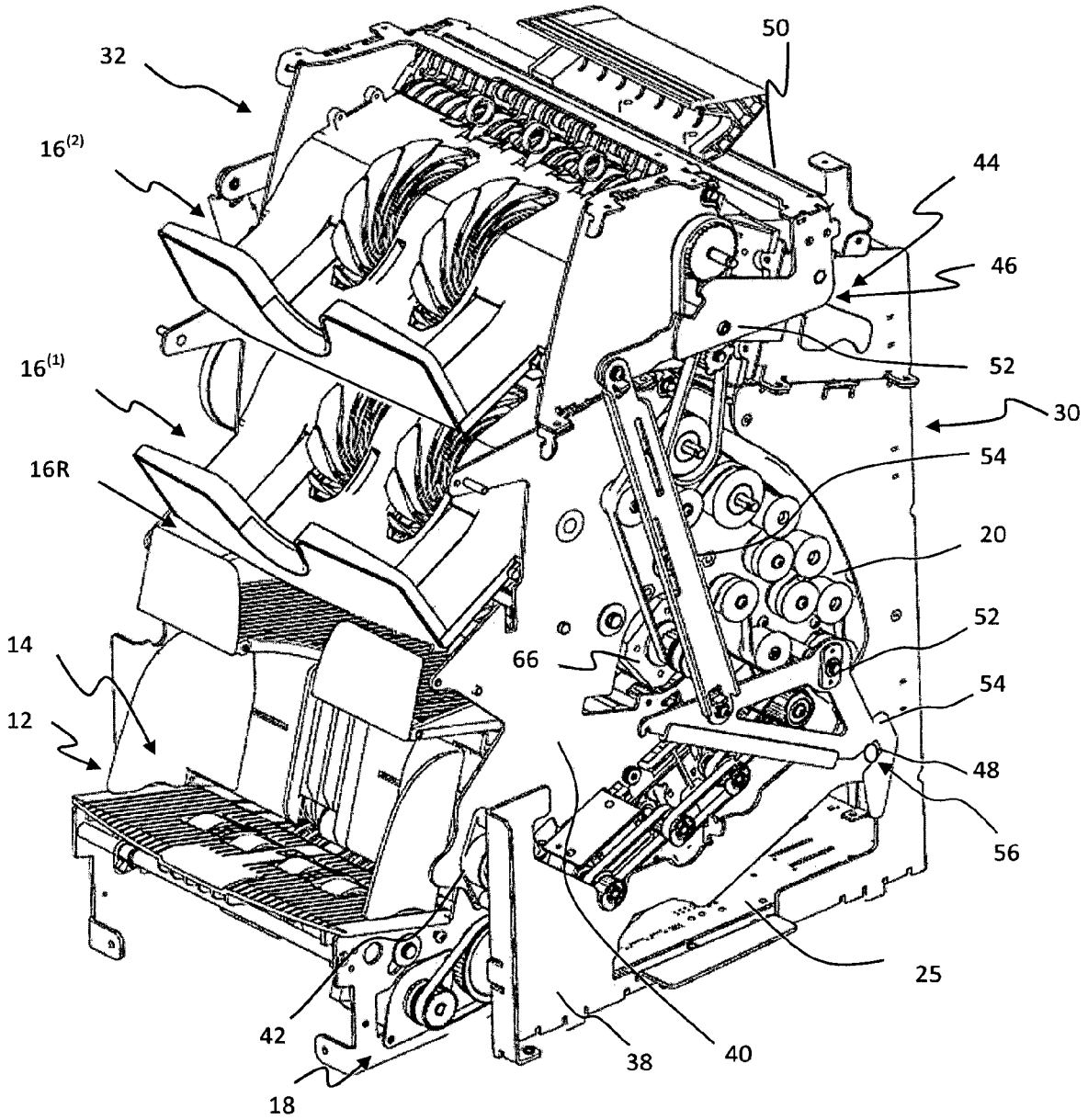
Figure 2:
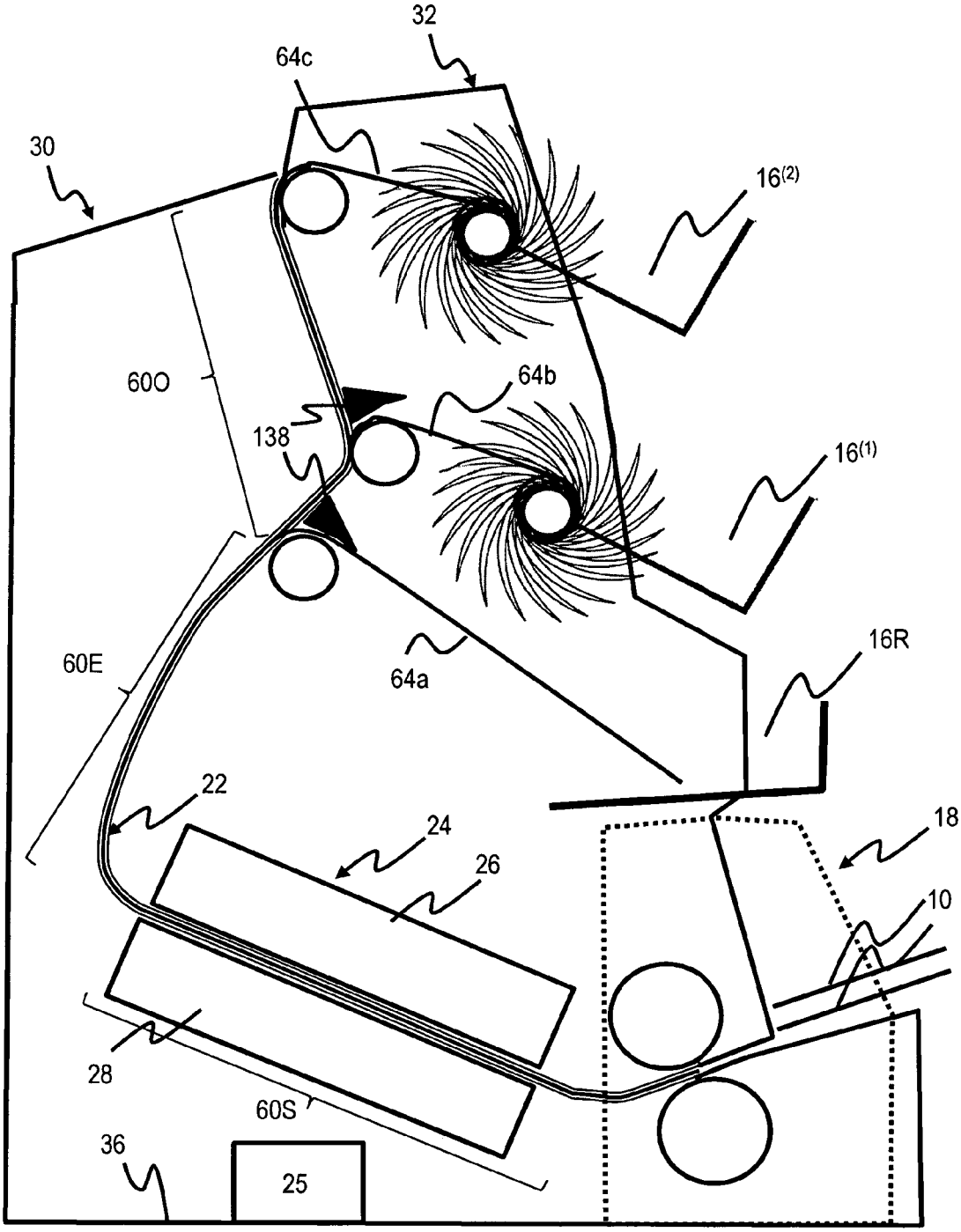
FIG. 2 shows a schematic left side view of the apparatus in FIGS. 1A and 1B in a closed position.

In FIGS. 1A and 1B and 2, an apparatus for processing documents of value, in this embodiment banknotes 10, comprises in a housing an input section 12 having an input receptacle 14 for receiving a stack of banknotes to be processed, and output pockets 16 for receiving processed banknotes. The output pockets 16 are arranged above the input receptacle 14 and are accessible from the front of the apparatus as is the input receptacle 14. For simplicity, the housing is not shown in the Figures.

The input section 12 further comprises a singler 18 for singling a stack of documents of value received in the input receptacle 14.

The apparatus further comprises a transport system 20 arranged to transport documents singled by the singler 18 one-by-one from the singler 18 along a transport path 22 to the output pockets 16. The transport path 22 has branches leading to the output pockets 16. Said branches start at branchings of the transport path. A main section 60 of the transport path 22 is the section of the transport path from the singler 18 to the topmost branching.

The apparatus further comprises a sensor arrangement 24 arranged to detect physical properties of documents transported along the transport path 22 and emit sensor signals representing the result of the detection.

A control unit 25 is connected to the sensor arrangement 24 and the transport system 20. It is arranged to receive sensor signals of the sensor arrangement 24 generated for a document passing the sensor arrangement 24 and to control the transport system 20 by emitting control signals in response to the sensor signals. In particular, the control unit 25 is arranged to determine from the sensor signals which of the output pockets the document is to be transported to and to control the transport system to transport the document in response to the sensor signals output by the sensor arrangement 24 to said output pocket 16 determined.

The apparatus, in particular the transport system 20, is arranged to transport the banknotes with their short edge parallel to the transport direction.

In this embodiment, the apparatus comprises a stationary part 30 and a movable part 32.

The stationary part 30 comprises a chassis 34 including a base plate 36 and first sidewalls 38. The input section 12 is held in the chassis 34 and comprises the singler 18 as well as the input receptacle 14 for receiving a stack of documents to be singled.

The movable part 32 comprises second sidewalls 40 and the output pockets 16. In this embodiment three output pockets are arranged above the input receptacle 14 and above each other.

Further, as shown in FIG. 2, the stationary part 30 and the movable part 32, respectively, hold two parts 26 and 28 of the sensor arrangement 24, these parts being arranged on opposite sides of the transport path 22. In this embodiment, these sensor parts 26 and 28 are provided as sensor modules 26 and 28, respectively.

Figure 3:
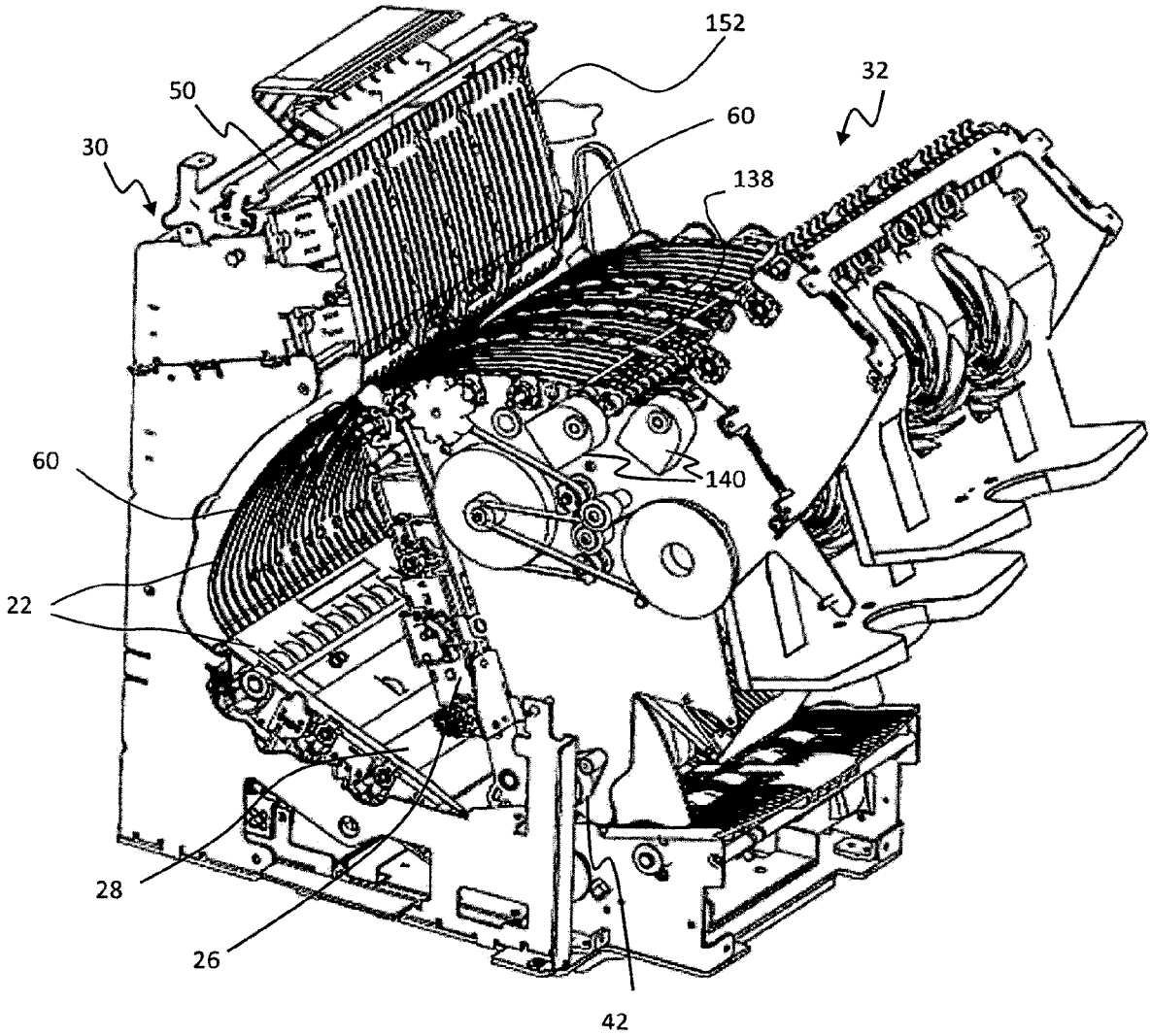
FIG. 3 shows a left perspective view of the apparatus in FIGS. 1A and 1B in an open position.

The movable part 32 is mounted to the stationary part 30, more precisely to the chassis 34, via pin-joints 42, so as to be pivotable between two positions relative to the stationary part 30, a closed position illustrated in FIGS. 1A and 1B and an open position illustrated in FIG. 3. The pin-joints or revolute 42 joints are arranged at the first and second sidewalls so that the movable part can be swiveled downwardly about an axis extending between the pin-joints 42.

In the closed position shown in FIGS. 1A and 1B, the stationary part 30 and the movable part 32 are arranged to form a section of the transport path 22 leading from the input section 12 to the output pockets 16. Thus, the closed position is also an operating position. Further, a latching mechanism 44 holds the movable part in the closed position. The latching mechanism 44 comprises lever arrangements 46 mounted on both second sidewalls 40 of the movable part 32 and studs 48 on both first sidewalls 38 of the stationary part 30. The lever arrangements 46 are connected by a transversal bar 50 and can be swiveled about revolute joints 52 held at the movable part 32. The studs 48 are arranged on both first sidewalls 38 of the stationary part 30 near the bottom and near the top. Levers 54 of the lever arrangements 46 have recesses 56 complementary to the studs 48. In a locked state, the stationary part 30 and movable part 32 are fixed in the closed position, the recesses 56 engaging with the complementary studs 48. That way, a suitable distance between the stationary part 30 and the movable part 32 is obtained which ensures proper transport of documents along the transport path and proper relative positions of the sensor parts 26 and 28. By moving the levers 54 into unlocked positions the studs 48 no longer engage the recesses 56 and the movable part 32 is free to be swiveled.

In the closed position, a user may actuate, i. e. unlatch, the latching mechanism 44 so that the movable part 32 can be swiveled downwards into the open position (see FIG. 3). In the open position the movable part 32 is pivoted away from the stationary part 30 so as to expose at least a section, in this embodiment main section 60, of the transport path 22. As the section 60 of the transport path 22 is formed by the two parts 30 and 32 it is accessible so that documents jammed in the section 60 of the transport path 22 are easily accessible and can be removed easily.

Retaining elements 58 mounted between studs 62 of the movable part 32 and the stationary part 30 on both sides, in this embodiment gas springs, are arranged to provide a restoring force to the movable part 32 when it is in the open position. Further, it serves as a limiting member that limits the swiveling motion of the movable part 32 in a downward direction.

The stationary part 30 and the movable part 32 have faces forming the main section 60 of the transport path when in the closed position. The faces are of complementary shape forming the main section 60 of the transport path 22. In this embodiment the main section 60 of the transport path is generally S-shaped. It starts with a straight sensing section 60S passing through the sensor arrangement 24 and then bends upwards and in a direction to the front of the apparatus to form an evaluation section 60E. On the one hand, the shapes of the stationary part 30 and the movable part 32, in particular of their faces forming the main section 60 of the transport path, are adapted to allow transport of banknotes by the rollers when in the closed position. On the other hand, the shapes are adapted to allow a swiveling motion of the movable part from the closed position into the open position. In this embodiment, the evaluation section 60E is curved like an arc of a circle and the stationary and movable part are adapted to form this evaluation section 60E. The length of the evaluation section 60E is chosen so that evaluating sensor signals captured for a banknote by control unit 25 is completed to the extent that one of the output pockets is determined the banknote is transported to before the banknote reaches the first deviating element or branching. The main section 60 of the transport path then bends upwards and slightly back to form a sorting section 600. The sections of the main section after the evaluation section 60E have output branches 64 leading to the output pockets 16. The transport path 22 extends parallel to an at least approximately vertical plane V. The swiveling or pivoting motion of the movable part 32 is also parallel to that plane.

Correspondingly, the housing comprises two parts, one part being mounted to the stationary part, the other being mounted to the movable. The parts are adapted to form a closed housing when the movable part is in the closed state and to allow moving the mobile part with the part of the housing mounted thereto into the open position.

The stationary part 30 and the movable part 32 comprise the transport system 20. Each of these parts comprises transport elements of the transport system 20 to transport singled documents along the transport path 22. Whereas stationary part 30 comprises passive transport elements that are not directly driven, e. g. rollers, movable part 32 comprises driven transport elements to transport said singled documents along transport path 22. In particular, the movable part 32 comprises a transport motor 66 and transport elements, e. g. rollers, driven by means of the transport motor 66. The movable part 32 may optionally comprise further transport elements.

In this embodiment the stationary part 30 and the movable part 32 are of modular design and comprise complementary stationary and movable modules, respectively.

Figure 4:
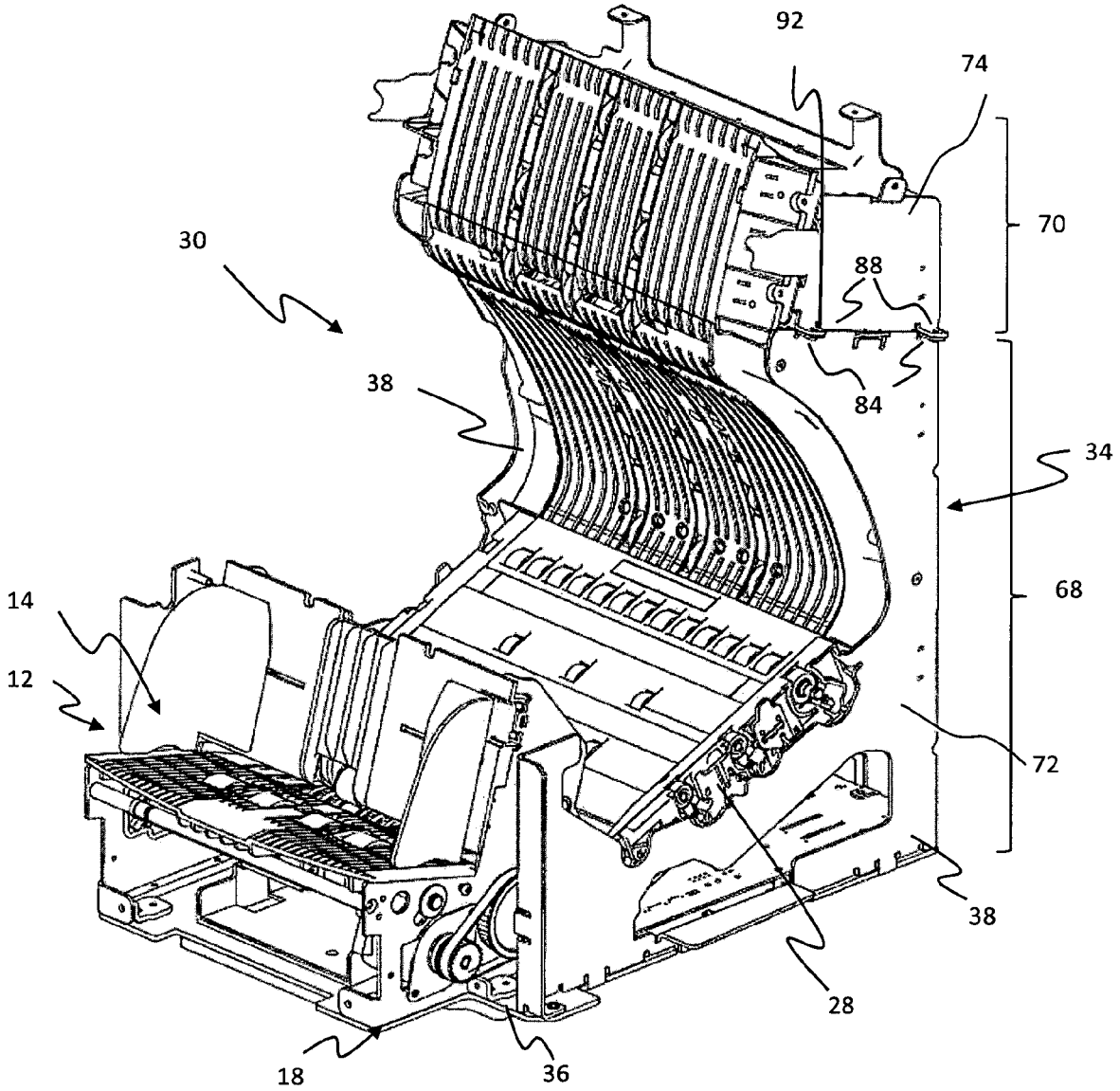
FIG. 4 shows a perspective view of a stationary part of the apparatus of FIGS. 1A and 1B.
Figure 7:
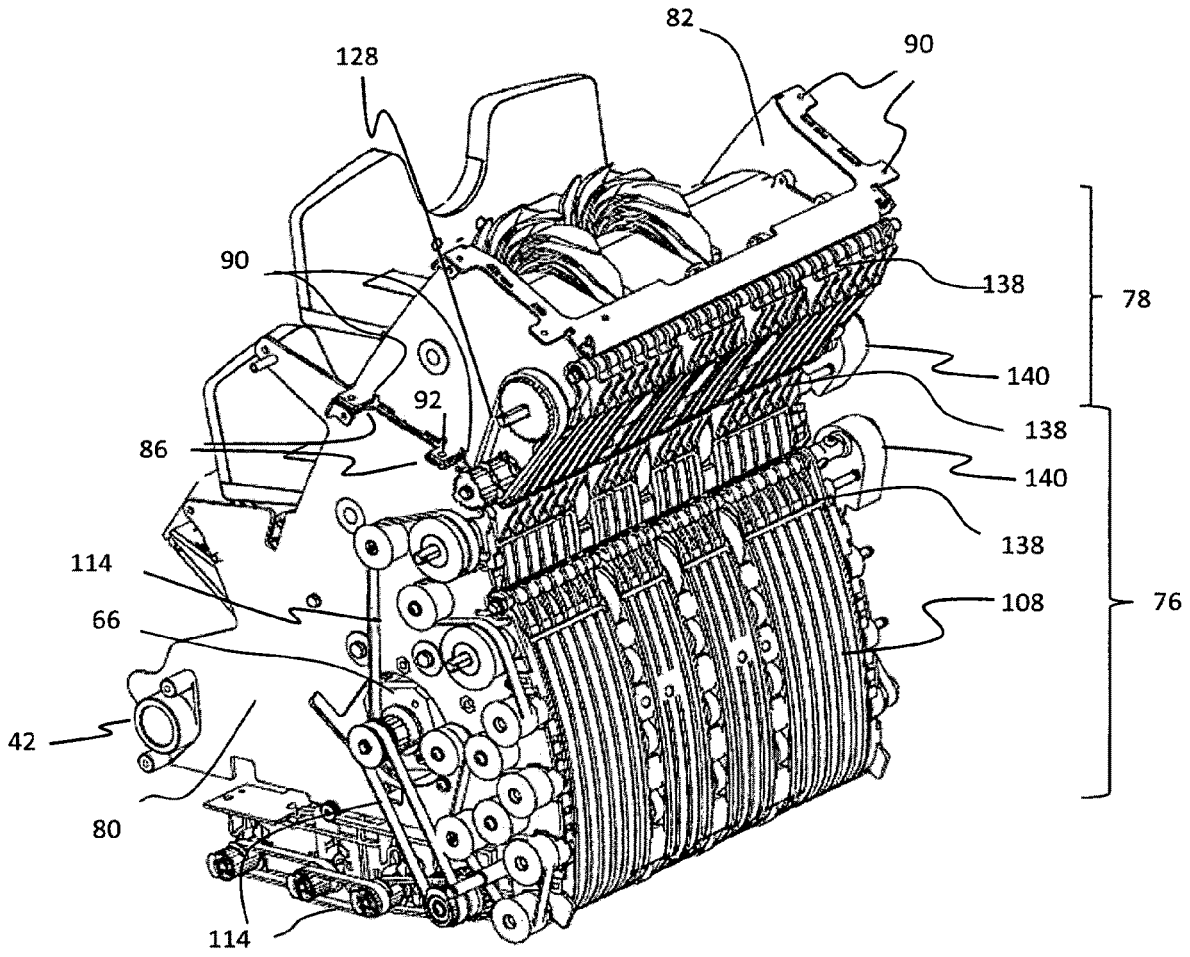
FIG. 7 shows a perspective view of the movable part of the apparatus in FIGS. 1A and 1B.

The stationary part 30 illustrated in FIG. 4 comprises a stationary base module 68 and a stationary extension module 70 fastened to the stationary base module 68. Hence the first sidewalls 38 are formed by corresponding module sidewalls 72 and 74, respectively, of the stationary base and extension module 68 and 70. The movable part 32 illustrated in FIG. 7 comprises a movable base module 76 and a movable extension module 78 fastened to the movable base module 76. Thus, also the second sidewalls are formed by corresponding module sidewalls 80 and 82 of the movable base and extension module 76 and 78, respectively.

The sidewalls of the base and extension modules comprise complementary fastening elements arranged to fasten the respective extension module to the module below it. In this embodiment, the sidewalls comprise lugs 84, 86 and 88, 90 respectively, adapted to be connected by screws 92, 94.

Figure 5:
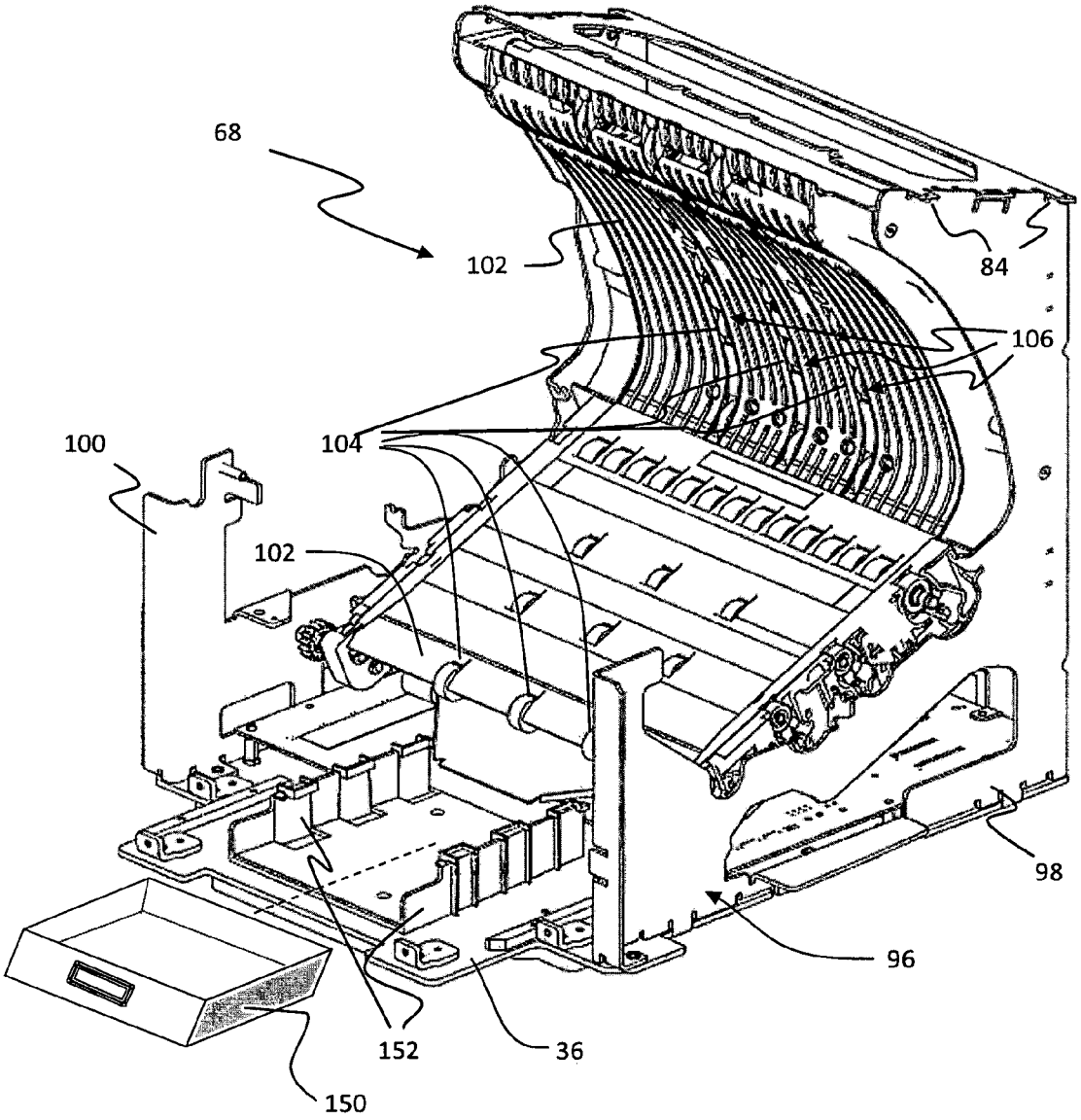
FIG. 5 shows a perspective view of a stationary base module of the stationary part in FIG. 4.

In FIG. 5, the stationary base module 68 comprises a stationary base chassis 96 comprising the base plate 36 and first base module sidewalls 98, 100. In the stationary base chassis 96 the stationary base module 68 comprises guiding elements 102 and rollers 104 protruding partly through openings 106 in said guiding elements 102 as transport elements. The guiding elements 102 form guiding surfaces on which banknotes can slide when being transported.

Figure 8:
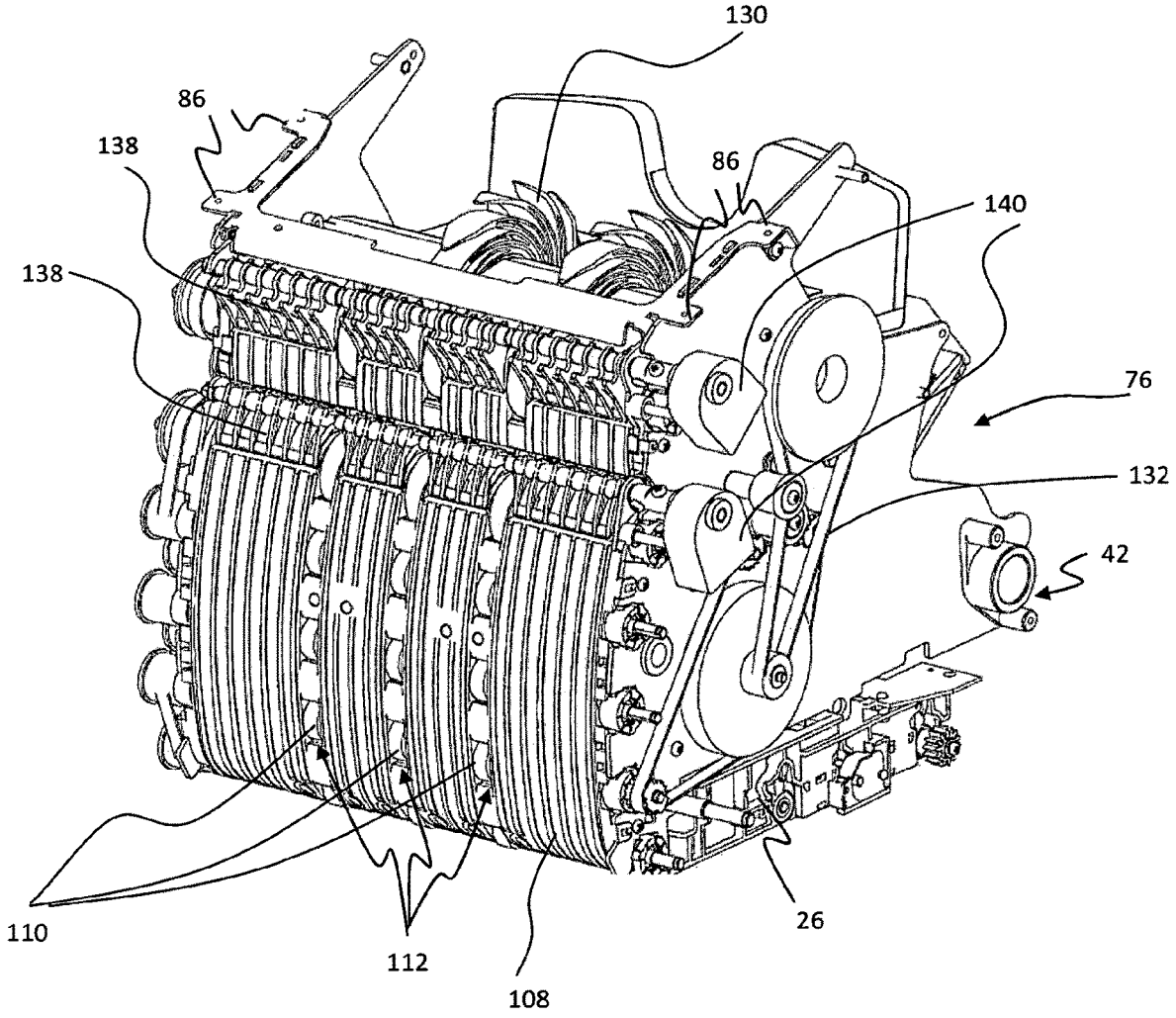

In FIG. 8, the movable base module 76 comprises in a movable base chassis 107 as transport elements guiding elements 108 and rollers 110 protruding partly through openings 112 in said guiding elements 108. The guiding elements 108 form guiding surfaces on which banknotes can slide when being transported. Contrary to the rollers 104 of the stationary base module 68, the rollers 110 of the movable base module 76 are driven by the transport motor 66 via one or more belts 114. The rollers 104 and 110 in the base modules are arranged to form transport roller nips when the movable part is in the closed state. Banknotes are driven along the transport path 22 by the transport rollers 110 of the movable part 32 when passing the nips.

Figure 6:
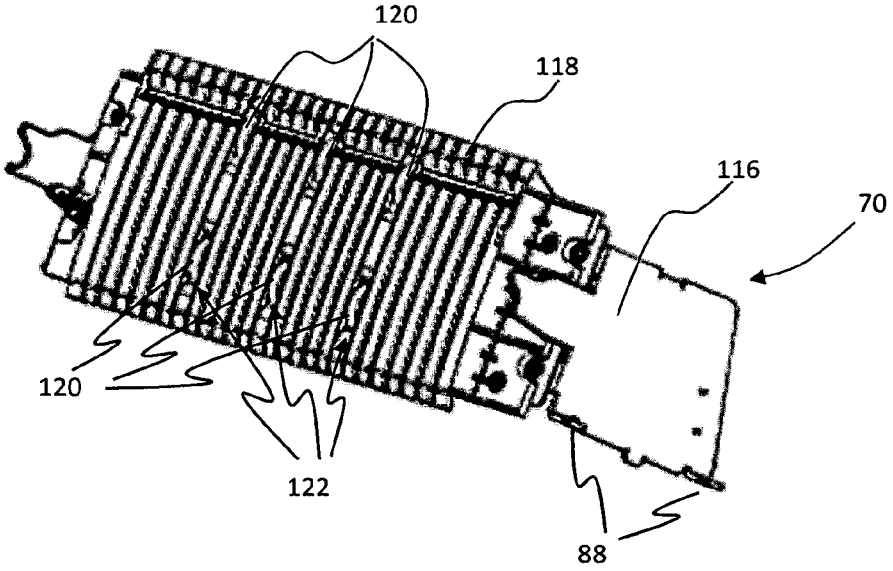
FIG. 6 shows a perspective view of a stationary extension module of the stationary part in FIG. 4.

Analogously, the stationary extension module 70 illustrated in FIG. 6 comprises in a stationary extension chassis 116 as transport elements a guiding element 118 and rollers 120 protruding partly through openings 122 in said guiding element 118.

Figure 9:
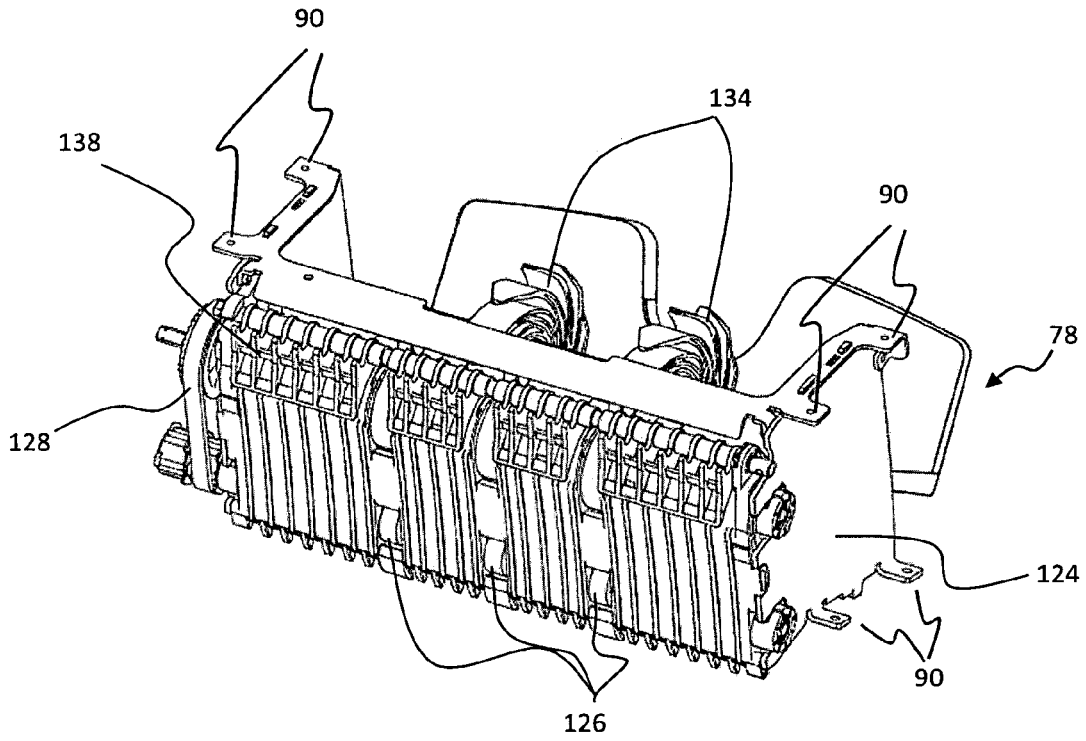
FIG. 9 shows a perspective view of a movable extension module of the stationary part in FIG. 7.

Further, the movable extension module 78 illustrated in FIG. 9 comprises in a movable extension chassis 124 transport rollers 126 that are driven via a belt 128 by a driven element of the movable module, the movable extension module is mounted on (see FIG. 1B). As in the case of the base modules 68 and 76 the rollers 120 and 126 of the extension modules are arranged to form transport roller nips when the movable part is in the closed state. Banknotes are driven along the transport path 22 by the transport rollers 126 of the movable extension module 78 when passing the nips.

The output pockets 16 are part of the movable part 32 and arranged one above the other. The lowermost output pocket is a reject pocket 16R; the other output pockets serve as sorting output pockets. In particular, the movable base module 76 comprises that reject pocket 16R and a first of the sorting output pockets $\mathbf{16}^{(1)}$ and branches 64*a*, 64*b* of the transport path 22 leading to said pockets.

The reject pocket 16R is provided to receive banknotes that cannot be sorted into one of the other output pockets because they are not in a singled state or are scewed relative to the transport path.

The first sorting output pocket $\mathbf{16}^{(1)}$ comprises a stacker wheel 130 to stack banknotes transported to the first sorting output pocket $\mathbf{16}^{(1)}$. The stacker wheel 130 of the movable base module is driven by the transport motor 66 via at least one belt 132.

The movable extension module provides a second sorting output pocket $\mathbf{16}^{(2)}$ arranged at the end of another branch 60*c* of the transport path 22. A stacker wheel 134 for stacking banknotes in the second sorting output pocket $\mathbf{16}^{(2)}$ is driven by the movable base module 76 via another belt 136 (see FIGS. 1A, 11).

At the branchings of the transport path 22 diverting elements 138 and actuators 140 (see FIGS. 1A and 8) for actuating the diverting elements 138 are provided. Both are held in the movable part 32, i. e. those for the reject pocket 16R and the first sorting output pocket $\mathbf{16}^{(1)}$ at the movable base chassis 107. A diverting element of the first movable extension module 78 may be held in fixed position to divert any banknote reaching the module to the second sorting output pocket $\mathbf{16}^{(2)}$. The actuators may be solenoids connected to and controlled by control unit 25.

Figure 10:
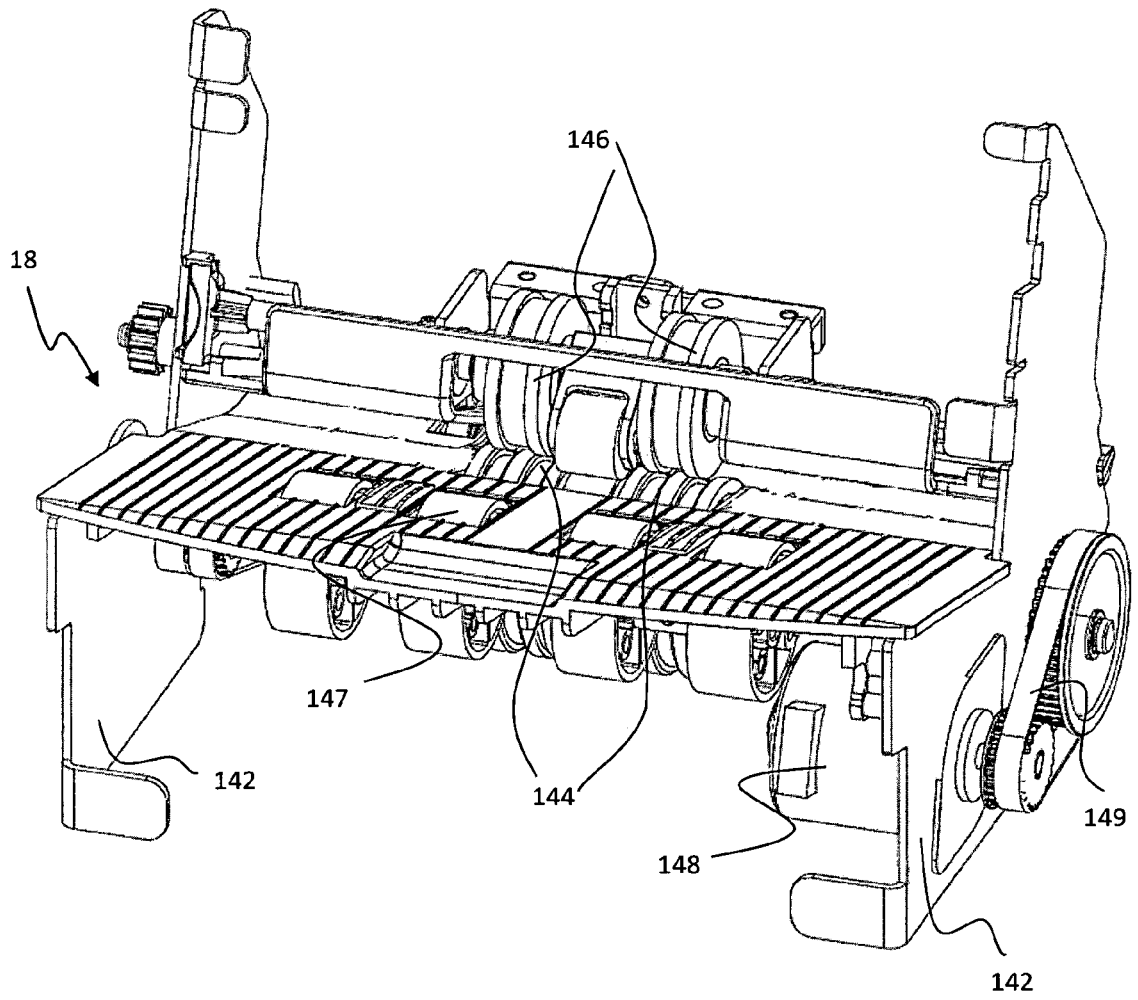
FIG. 10 shows a right perspective view of the singler of the apparatus in FIGS. 1A and 1B.

In FIG. 10, the singler 18 is a self-contained singler module arranged in the stationary part 30, in this embodiment in the stationary base chassis 96. The singler module 18 has a singler chassis 142. Drive rollers 144 and separating rollers 146 arranged opposite to the drive rollers 144 to form a singling gap are directly or indirectly mounted in the singler chassis 142. Feed rollers 147 transport a lowermost banknote of a stack of banknotes towards the singling gap where it is advanced by the driver rollers 144. The separating rollers 146 are arranged to retain a banknote that sticks to a banknote underneath it which is moved by the drive rollers 144. A singler motor 148 of the singler module 18 also held in singler chassis 142 drives the feed rollers 147 and via a belt 149 the drive rollers 144. The motor 148 is connected to control unit 25 which is arranged to control operation of the singler 18.

Below the singler 18 and in the stationary part 30, in this embodiment in the stationary base module 68, a dust collection element 150 is arranged for collecting dust resulting from the operation of the singler 18 above (see FIG. 5). The dust collection element 150 comprises a box held between two guiding elements 152 so as to be pulled from a collecting position in which dust falling from within the apparatus is collected on or in the collection element 150 to a position allowing removing of the collected dust from the collection element 150 and pushed back into the collecting position. In this embodiment, the dust collection element 150 is a box which sits above base plate 36 of the stationary part 30, in more detail base plate 36 of the stationary base module 68, but below the singler 18 so that it can be drawn out to the front of the apparatus and emptied.

The sensor arrangement 24 illustrated in FIG. 2 has the first part 26 and the second part 28 formed by upper and lower sensor modules 26 and 28 respectively arranged on opposite sides of the sensing section 60S of the transport path 22. Whereas the upper sensor module 26 is held in the movable part 32, in this embodiment in movable base module 76, the lower sensor module 28 is mounted in stationary part 30, in this embodiment in stationary base module 68. The sensor arrangement 24 comprises optical sensors and a magnetic sensor to obtain corresponding properties of a banknote while being transported past the sensing modules 26 and 28 and generating signals therefrom.

The control unit 25 on base plate 36 (see FIG. 2) is connected to the sensors of the sensor arrangement 24 via sensor signal connections and to the transport motor 66, the singler motor 148 and the actuators 140 of the diverting elements 138 via control connections. The control unit 25 comprises a processor and memory storing instructions of a computer program. In operation, documents are classified into predetermined sorting classes. Further, sorting classes are assigned to the output pockets 16 so that documents classified to belong to a particular sorting class are stacked in the output pocket 16 the class is assigned to. When executing the instructions, the processor controls the motors 66 and 148 and actuators 140. Further, it receives sensor signals of the sensors of sensor arrangement 24 captured for a document passing the sensor arrangement 24, determines a sorting class using the sensor signals and controls the transport system 20, in particular at least one of the actuators 140 by transmitting controls signals to the at least one actuator 140 in response to the sorting class determined for a document. The processor controls the at least one actuator 140 so that the document is directed to the output pocket 16 assigned for the sorting class.

In particular, when detecting banknotes at least partially overlapping and being transported jointly ("double feeds"), the banknotes are directed to reject pocket 16R.

In operation, banknotes of a stack of documents placed in the input receptacle 14 are singled by singler 18 and fed to the transport system 20 which transports the banknotes one-by-one. The transport system 20 transports a banknote fed by the singler 18 along the sensing section 60S, where the sensor arrangement 24 detects properties of the banknote and generates corresponding sensor signals representing the properties. The control unit 25 receives the sensor signals. While the banknote is transported along the evaluation section 60E of the transport path 22, control unit 25 classifies the banknote using the sensor signals and generates control signals for controlling the transport system 20, in particular, the actuators and optionally the transport motor 66. At least one of the actuators move a corresponding at least one of the diverting elements in response to the control signals, so that the banknote leaving the evaluation section 60E and entering the sorting section 600 of the transport path 22. In the sorting section 600 the banknote is directed to an output pocket determined by the control unit 25.

Figure 11:
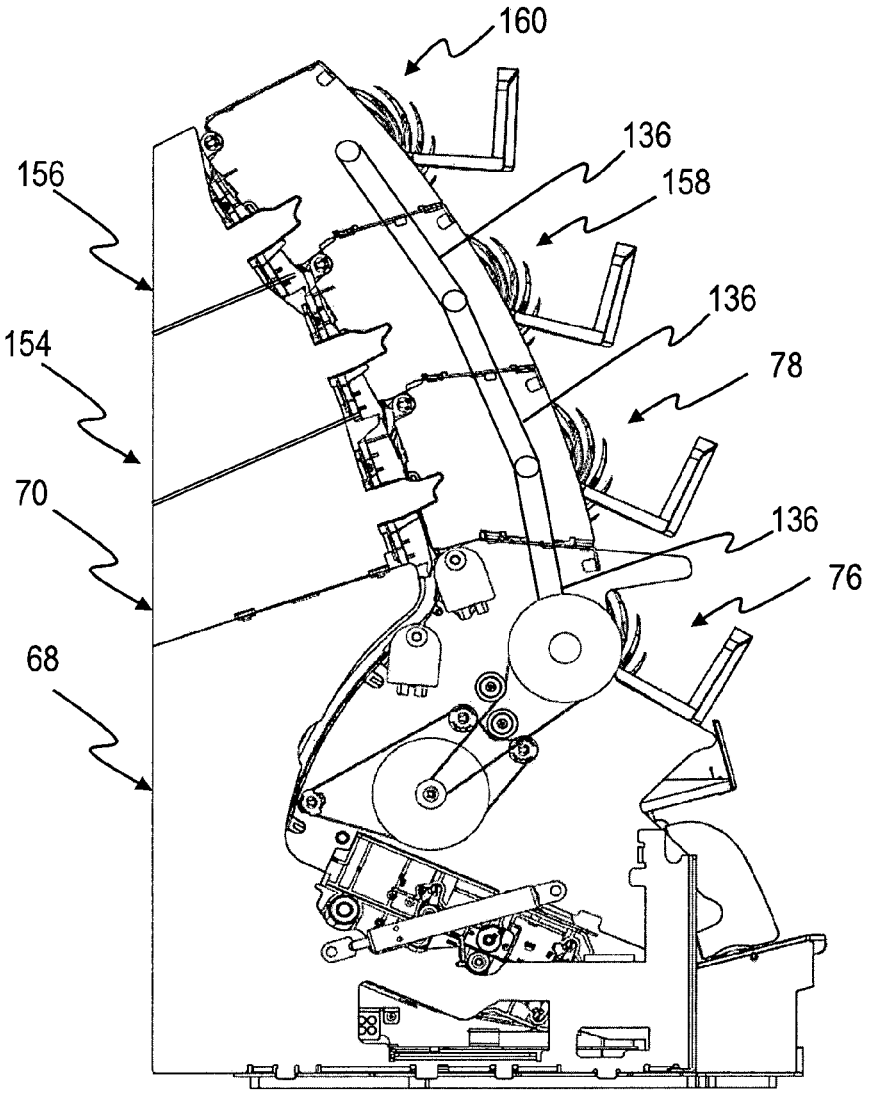
FIG. 11 shows a schematic left side view of a second embodiment of an apparatus for processing documents of value in a closed position.
Figure 12:
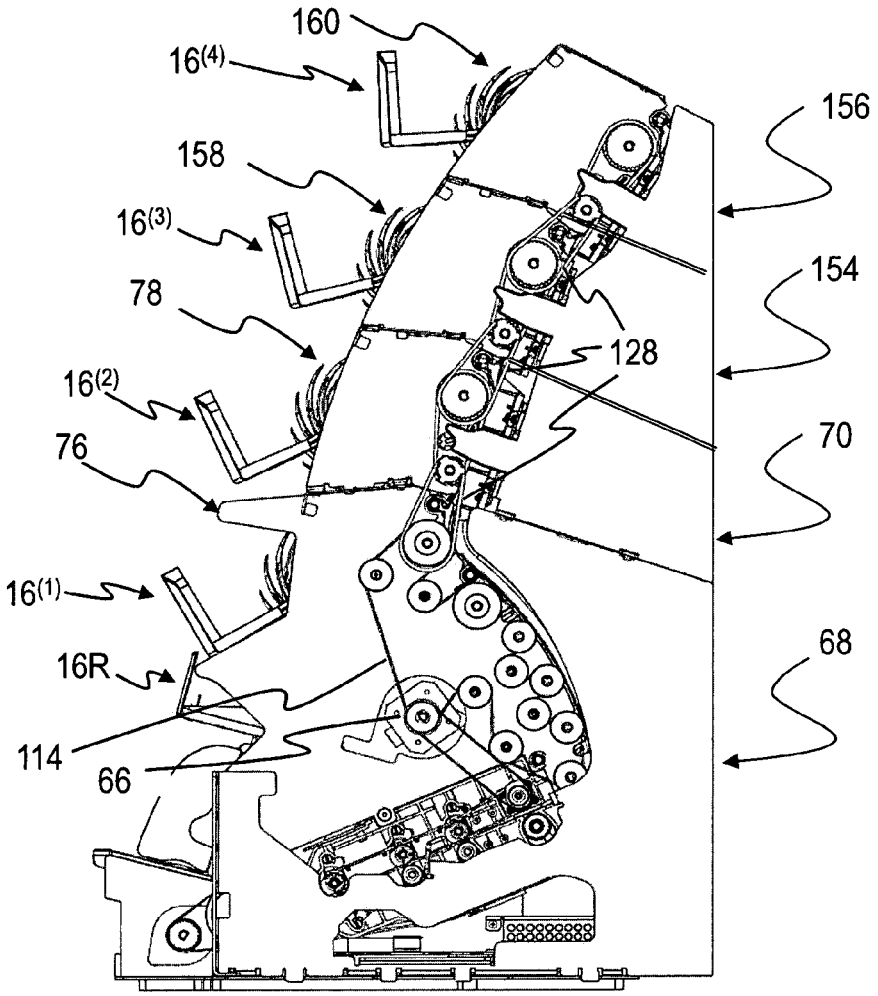
FIG. 12 shows a schematic right side view of the apparatus in FIG. 11.

A second embodiment of the apparatus illustrated in FIGS. 11 and 12 differs from the first embodiment in that it comprises two further extension modules, i. e. a second and third stationary extension module 154 and 156 respectively, and movable extension modules, i. e. a second and third movable extension module 158 and 160, respectively, arranged vertically above the first extension modules. The stationary and movable base modules and the first stationary and movable extension modules correspond to those of the first embodiment; the reference numerals and the description with respect to these modules applies also for the second embodiment, unless explicitly stated in the following.

The first to third extension modules are generally identical. However, actuators for actuating respective diverting elements are arranged in the first and second movable extension module only, but not in the third extension module. The third extension module is analogous to the first extension module of the first embodiment. In this second embodiment, the actuators are solenoids.

The transport elements and the stapler wheels of the movable extension modules are driven by the respective extension modules right below them by means of belts 136 as shown in FIG. 11 for the stapler wheels and in FIG. 12 for the transport rollers.

Each of these extension modules is mounted on top of the respective extension module below it by means of the lugs and screws.

The control unit differs from the control unit of the first embodiment in that it is connected to all actuators and adapted to control these actuators.

Figure 13:
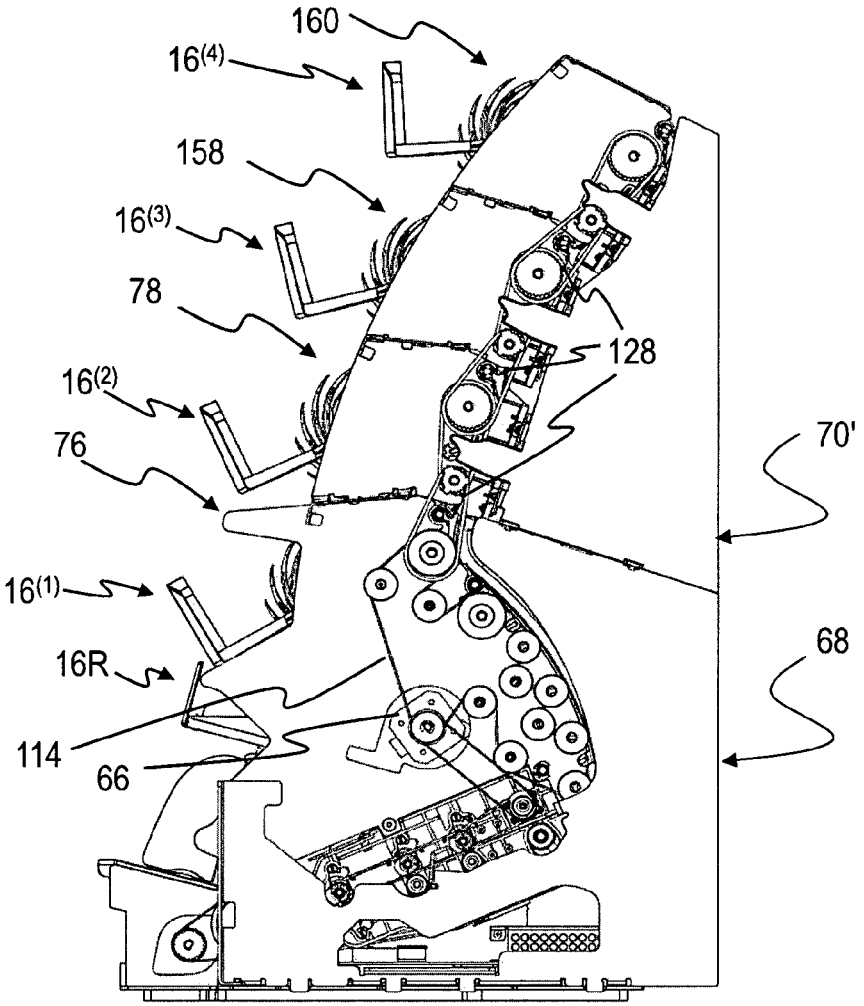
FIG. 13 shows a schematic right side view of a third embodiment apparatus of an apparatus for processing documents of value in a closed position

A third embodiment illustrated schematically in FIG. 13 differs from the second embodiment in that the first, second and third stationary extension modules 70, 154, 156 are replaced by a single stationary extension module 70' that is mounted to stationary base module 68 in the same manner as module 70. The stationary and movable base modules and the movable extension modules correspond to those of the second embodiment; the reference numerals and the description with respect to these modules applies also for the third embodiment, unless explicitly stated in the following.

The single stationary extension module 70' is arranged to form with the three movable extension modules 78, 158 and 160 a section the transport path as in the second embodiment. This allows precise alignment of the modules. In particular, the stationary extension module 70' comprises a arrangement of transport elements corresponding to the transport elements of the first, second and third stationary extension modules 70, 154, 156.

Further embodiments differ from the second embodiment in that the apparatus comprises further extension modules analogous to the second embodiment. The control unit is adapted accordingly.

The invention claimed is:

1. An apparatus for processing documents of value comprising:

a stationary part and a movable part, wherein said stationary part comprises a singler for singling a stack of documents, wherein said movable part comprises at least two output pockets for receiving processed documents, wherein said movable part is mounted to the stationary part so as to be pivotable between a closed position and an open position, wherein said stationary part and said movable part are arranged to form a transport path when said movable part is in the closed position, and wherein said stationary part and said movable part are arranged to allow access to at least a section of said transport path when said movable part is in the open position, wherein the apparatus is arranged to transport singled documents of value from said singler along said transport path to said output pockets, wherein said stationary part and said movable part comprise transport elements to transport said singled documents along the transport path and wherein the movable part comprises a transport motor arranged to drive at least some of those transport elements.

2. The apparatus according to claim 1, wherein said movable part is mounted to said stationary part so that it is pivotable in a vertical plane.

3. The apparatus according to claim 2, wherein said transport path extends in a plane parallel to said vertical plane or in said vertical plane.

4. The apparatus according to claim 1, further comprising a limiting member arranged to limit a pivoting range of the movable part.

5. The apparatus according to claim 1, wherein at least some of said transport elements of the movable part are arranged to be driven by the transport motor.

6. The apparatus according to claim 1, wherein said transport path has branches leading to said output pockets and said transport elements comprise at least one diverting element arranged to direct a document transported along the transport path towards one or the other of said branches.

7. The apparatus according to claim 6, wherein the section of the transport path from said singler to the topmost of said branches is accessible for a user when the movable part is in the open position.

8. The apparatus according to claim 6, wherein a section of the transport path from said singler to a topmost portion of said branches is accessible for a user when the movable part is in the open position; wherein said singler is arranged below the output pockets.

9. The apparatus according to claim 1, wherein only the movable part needs to be brought into the open position in order to get access to the section of the transport path.

10. The apparatus according to claim 1, wherein said singler is a singler module mounted in said stationary part.

11. The apparatus according to claim 10, wherein said singler module is mounted in said stationary part such that it can be removed as a whole from the stationary part.

12. The apparatus according to claim 10, wherein said singler module comprises a singler motor arranged to drive the singler.

13. The apparatus according to claim 1, wherein said stationary part comprises a stationary base module and a first stationary extension module mounted on top of the stationary base module and wherein said movable part comprises a movable base module and a first movable extension module mounted to the movable base module and having an output pocket and wherein said base modules and said extension modules respectively are complementary to each other to form at least sections of said transport path.

14. The apparatus according to claim 13, wherein said singler is arranged in the stationary base module and the transport motor is arranged in the movable base module.

15. The apparatus according to claim 13, wherein said movable part comprises at least one further movable extension module mounted on top of the first movable extension module or one other of the at least one further movable extension modules and having an output pocket, and wherein said first movable extension module and the at least one further extension module are arranged to form a section of said transport path when said stationary part and said movable part are in the closed position.

16. The apparatus according to claim 15, wherein the at least one further movable extension module comprises transport elements and is arranged so that at least some of the transport elements are driven by the movable extension module below said at least one further movable extension module.

17. The apparatus according to claim 15, wherein at least one of said at least one further movable extension modules comprises a diverting element and an actuator for actuating the diverting element, said diverting element and actuator being arranged to direct documents of value to a branch of the transport path leading to one other of the at least one further movable extension modules or to the output pocket of said at least one of said extension modules in response to signals received by the actuator.

18. The apparatus according to claim 13, wherein said stationary part further comprises at least one further stationary extension module mounted on top of the first stationary extension module or one other of the at least one further stationary extension modules and said movable part comprises at least one further movable extension module mounted on top of the first movable extension module or one other of the at least one further movable extension modules and having an output pocket, the at least one further stationary extension module and the at least one further extension module being arranged to form a section of said transport path when said stationary part and said movable part are in the closed position.

19. The apparatus according to claim 1 wherein between the transport path and at least one of said output pockets a stacker wheel is arranged to stack documents of value transported to said output pocket into said output pocket.

20. The apparatus according to claim 19, wherein said stacker wheel is driven by said transport motor.

21. The apparatus according to claim 1, further comprising a sensor arrangement having a first sensor part mounted in the stationary part and a second sensor part mounted in the movable part on opposite sides of the transport path and between the singler and the output pockets.

22. The apparatus according to claim 1 further comprising a dust collection element arranged in the stationary part below the singler and arranged to be drawn out of the stationary part to allow removing dust from the dust collection element.

23. An apparatus for processing documents of value comprising:

a stationary part and a movable part, wherein said stationary part comprises a singler for singling a stack of documents, wherein said movable part comprises at least two output pockets for receiving processed documents, wherein said movable part is mounted to the stationary part so as to be pivotable between a closed position and an open position, wherein said stationary part and said movable part are arranged to form a transport path when said movable part is in the closed position, and wherein said stationary part and said movable part are arranged to allow access to at least a section of said transport path when said movable part is in the open position, wherein the apparatus is arranged to transport singled documents of value from said singler along said transport path to said output pockets, wherein said stationary part comprises a stationary base module and a first stationary extension module mounted on top of the stationary base module, wherein said movable part comprises a movable base module and a first movable extension module mounted to the movable base module and having an output pocket, wherein said base modules and said extension modules respectively are complementary to each other to form at least sections of said transport path, wherein said movable part comprises at least one further movable extension module mounted on top of the first movable extension module or one other of the at least one further movable extension modules and having an output pocket, wherein said first movable extension module and the at least one further extension module are arranged to form a section of said transport path when said stationary part and said movable part are in the closed position, and wherein the at least one further movable extension module comprises transport elements and is arranged so that at least some of the transport elements are driven by the first movable extension module or the one other of the at least one further movable extension modules below said at least one further movable extension module.

24. The apparatus according to claim 23, wherein said stationary part further comprises at least one further stationary extension module mounted on top of the first stationary extension module or one other of the at least one further stationary extension modules, and wherein the at least one further stationary extension module and the at least one further extension module being arranged to form a section of said transport path when said stationary part and said movable part are in the closed position.

25. The apparatus according to claim 24, wherein said transport path has branches leading to said output pockets and said transport elements comprise at least one diverting element arranged to direct a document transported along the transport path towards one or the other of said branches.

26. The apparatus according to claim 23, wherein at least one of said at least one further movable extension modules comprises a diverting element and an actuator for actuating the diverting element, said diverting element and actuator being arranged to direct documents of value to a branch of the transport path leading to one other of the at least one further movable extension modules or to the output pocket of said at least one further extension modules in response to signals received by the actuator.

27. An apparatus for processing documents of value comprising:

a stationary part and a movable part, wherein said stationary part comprises a singler for singling a stack of documents, wherein said movable part comprises at least two output pockets for receiving processed documents, wherein said movable part is mounted to the stationary part so as to be pivotable between a closed position and an open position, wherein said stationary part and said movable part are arranged to form a transport path when said movable part is in the closed position, and wherein said stationary part and said movable part are arranged to allow access to at least a section of said transport path when said movable part is in the open position, wherein the apparatus is arranged to transport singled documents of value from said singler along said transport path to said output pockets, wherein said stationary part comprises a stationary base module and a first stationary extension module mounted on top of the stationary base module, wherein said movable part comprises a movable base module and a first movable extension module mounted to the movable base module and having an output pocket, wherein said base modules and said extension modules respectively are complementary to each other to form at least sections of said transport path, wherein said movable part comprises at least one further movable extension module mounted on top of the first movable extension module or one other of the at least one further movable extension modules and having an output pocket, wherein said first movable extension module and the at least one further extension module are arranged to form a section of said transport path when said stationary part and said movable part are in the closed position, and wherein said stationary part and said movable part comprise transport elements to transport said singled documents along the transport path and wherein the movable part comprises a transport motor arranged to drive at least some of those transport elements, and wherein said singler is arranged in the stationary base module and the transport motor is arranged in the movable base module.

* * * * *